US006029746A

United States Patent [19]

Dodd

[11] Patent Number: 6,029,746

[45] Date of Patent: Feb. 29, 2000

[54] SELF-EXCITED JET STIMULATION TOOL FOR CLEANING AND STIMULATING WELLS

[75] Inventor: Rex A. Dodd, Midland, Tex.

[73] Assignee: Vortech, Inc., Midland, Tex.

[21] Appl. No.: 08/903,226

[22] Filed: Jul. 22, 1997

[51] Int. Cl.[7] ..... E21B 21/12

[52] U.S. Cl. ..... 166/312; 166/222

[58] Field of Search ..... 166/312, 222; 175/424; 239/548, DIG. 8, DIG. 13

[56] References Cited

U.S. PATENT DOCUMENTS

| | | | |
|---|---|---|---|
| 1,230,666 | 6/1917 | Carden . | |
| 1,333,390 | 3/1920 | Dickinson . | |
| 2,437,456 | 3/1948 | Bodine . | |
| 2,466,182 | 4/1949 | Peeps | 239/548 |
| 2,574,141 | 11/1951 | Brown . | |
| 2,661,065 | 12/1953 | McCoy . | |
| 2,933,259 | 4/1960 | Raskin . | |
| 3,520,362 | 7/1970 | Galle . | |
| 3,693,887 | 9/1972 | Brodlin . | |
| 3,730,269 | 5/1973 | Galle . | |
| 3,796,371 | 3/1974 | Taylor et al. . | |
| 3,842,907 | 10/1974 | Baker et al. . | |
| 3,850,135 | 11/1974 | Galle . | |
| 4,011,996 | 3/1977 | Tsuji et al. . | |
| 4,031,971 | 6/1977 | Miller . | |
| 4,041,984 | 8/1977 | Morel . | |
| 4,231,519 | 11/1980 | Bauer . | |
| 4,276,943 | 7/1981 | Holmes . | |
| 4,280,557 | 7/1981 | Bodine . | |
| 4,580,727 | 4/1986 | Moss . | |
| 4,630,689 | 12/1986 | Galle et al. . | |
| 4,669,665 | 6/1987 | Shay . | |
| 4,673,037 | 6/1987 | Bodine . | |
| 4,806,172 | 2/1989 | Adaci et al. . | |
| 4,923,169 | 5/1990 | Grieb et al. . | |
| 4,991,667 | 2/1991 | Wilkes et al. . | |
| 5,035,361 | 7/1991 | Stouffer . | |
| 5,067,655 | 11/1991 | Farago et al. . | |
| 5,133,502 | 7/1992 | Bendig et al. . | |
| 5,135,051 | 8/1992 | Facteau et al. . | |
| 5,165,438 | 11/1992 | Facteau et al. . | |
| 5,228,508 | 7/1993 | Facteau et al. . | |
| 5,423,483 | 6/1995 | Schwade . | |
| 5,732,885 | 3/1998 | Huffman | 239/416.5 |

*Primary Examiner*—David Bagnell
*Assistant Examiner*—Zakiya Walker
*Attorney, Agent, or Firm*—Locke Liddell & Sapp LLP; Monty L. Ross

[57] ABSTRACT

A self-excited jet stimulation tool for cleaning and stimulating wells includes an elongated tubular first member adapted on an upper end for connection to a running string. The first member includes an upper portion with a central bore open to a top of the tool, and a lower portion having a cylindrical shaped cavity open to a bottom surface of the first member. The cylindrical cavity is internally threaded in a lower portion. The central bore of the first member is open to the cylindrical cavity for communication of fluids supplied by the running string. The tool further includes an elongated tubular second member having a top with a central flat circular portion and a central bore with a diameter larger than the diameter of the central bore of the first member but less than the diameter of the cylindrical cavity of the first member. A conical shoulder extends downwardly and outwardly away from the central flat circular central portion and terminates in a flat annular ledge extending beyond the termination of the conical shoulder. An upper portion of the second member is externally threaded and receivable in the internally threaded lower portion of the first member. The second member has a lower nose portion with at least one discharge port connected by a passageway to the central bore of the second member. When the tool is assembled with the upper portion of the second member threadedly engaged in the lower portion of the first member an internal oscillation chamber is formed therein.

12 Claims, 5 Drawing Sheets

SELF-EXCITED JET STIMULATION TOOL FOR CLEANING AND STIMULATING WELLS

TECHNICAL FIELD

This invention relates generally to tools for cleaning wells and casing perforations and, more particularly, to a tool generating a self exciting pulsating jet flow used for cleaning and stimulating wells.

BACKGROUND OF THE INVENTION

A typical oil and gas well includes a casing string cemented in place between inside a hole bored through a hydrocarbon bearing formation. As used hereinafter, hydrocarbon is used to denote oil, gas, and any mixture thereof. In order for hydrocarbons to flow into the well bore, the casing is perforated in the interval containing the hydrocarbons. The high pressure jet from modern perforating guns pierces the casing and forms a hole by pulverizing cement and formation into compacted particles. Cement and material from the jet charge may fill the perforation tunnel. It is necessary to remove this debris from the perforation tunnel to increase the flow of hydrocarbons into the well bore.

In the usual course of producing hydrocarbons from an oil or gas well (hereinafter collectively referred to as "oil well"), paraffin contained in the oil may clog the perforations and casing. Scale comprised of various carbonates may precipitate out of solution from brine produced with the hydrocarbons and clog the perforations and well bore.

Prior art methods for cleaning and stimulating wells have included acidizing, re-perforating, fracturing with explosives and fracturing with hydraulic pressure. Such techniques have been used advantageously but have a number of significant disadvantages, not the least of which have resulted in introduction of foreign material such as acid and sand particles into the well. Prior art methods of cleaning have also included mechanical scrapers and hydraulic activated knives as taught in U.S. Pat. No. 2,574,141.

It has been suggested in the prior art to use acoustic energy for stimulating producing wells. A fluidic oscillator may be used to create pressure fluctuations to induce stress in the walls of the perforation tunnel, thereby increasing production and cleaning perforations as disclosed in U.S. Pat. Nos. 5,135,0531 and 5,228,508 issued to Facteau. The pressure fluctuations of the Facteau tool are generated from an oscillation chamber with two outlet ports. A similar fluidic oscillation chamber with dual outlet ports is disclosed in U.S. Pat. No. 5,165,438 also issued to Facteau.

Another stimulation tool using acoustic energy is disclosed in U.S. Pat. No. 3,520,362 issued to Galle.

Although the above recited tools seemed feasible, there exists a practical difficulty of delivering sufficient acoustic power to the producing formation for the desired stimulation and/or to the area desired to be cleaned.

As disclosed in IADC SPE paper 27468, and in Republic of China Patent No. 89201391, Helmholtz oscillator theory has been suggested for generating a pulsating jet flow in the jet nozzles in bits used in drilling oil wells as a means for improved hole cleaning and faster drilling rates. Pulsed high pressure water jets are known to have advantages over continuous jet streams for use in cutting materials, especially brittle materials. By exerting an alternating load on materials, pulsed jets can produce not only extremely high momentary pressures (i.e. water hammer effect) in the materials, but also absolute tensile stress, which gives rise to unloading destruction of brittle materials, through reflection of the stress waves.

The present invention applies Helmholtz jet technology in wells after the drilling phase (i.e. during initial cleaning and stimulation of new well and during remedial cleaning and stimulation of existing wells).

SUMMARY OF THE INVENTION

The present invention comprises a self-excited jet tool that creates a pulsating jet stream utilizing Helmholtz oscillation theory. The pulsating stream is caused by the emanation of vortices which are created inside the tool. As the vortices leave the tool and strike fluid contained in the annular space between the tool and the well casing (referred to in the industry as "backside fluid"), the vortices create pressure pulses. The cyclic pressure pulses break up brittle scale, dislodge plugging material in the perforations, and/or dislodge plugging material in open hole and screen liner type well completions.

The jet tool includes an elongated tubular first member adapted on an upper end for connection to a running string. The first member includes an upper portion with a central bore open to a top of the tool, and a lower portion having a cylindrical shaped cavity open to a bottom surface of the first member. The cylindrical cavity is internally threaded in a lower portion and has an internal diameter larger than the diameter of the central bore of the upper portion. The cylindrical cavity has an interior wall height of the unthreaded portion less than the diameter of the cylindrical cavity. The central bore of the first member is open to the cylindrical cavity for communication of fluids supplied by the running string.

The tool further includes an elongated tubular second member having a top with a central flat circular portion with a central bore having a diameter larger than the diameter of the central bore of the first member but less than the diameter of the cylindrical cavity of the first member. A conical shoulder extends downwardly and outwardly away from a central flat circular central portion. The conical shoulder terminates in a flat annular ledge extending beyond the termination of the conical shoulder. The second member is externally threaded on an upper portion and receivable in the internally threaded lower portion of the first member. The second member includes a lower nose portion having at least one discharge port connected by a passageway to the central bore of the second member. When the tool is assembled with the upper portion of the second member threadedly engaged in the lower portion of the first member, an internal oscillation chamber is formed therein.

In accordance with the present invention, the tool is less complicated to fabricate, less complicated to assemble, having no moving parts, and less complicated to use than prior art acoustic tools.

BRIEF DESCRIPTION OF THE DRAWINGS

A more complete understanding of the invention may be had by reference to the following Detailed Description when taken in conjunction with the accompanying Drawings in which.

DETAILED DESCRIPTION

Figure 1:
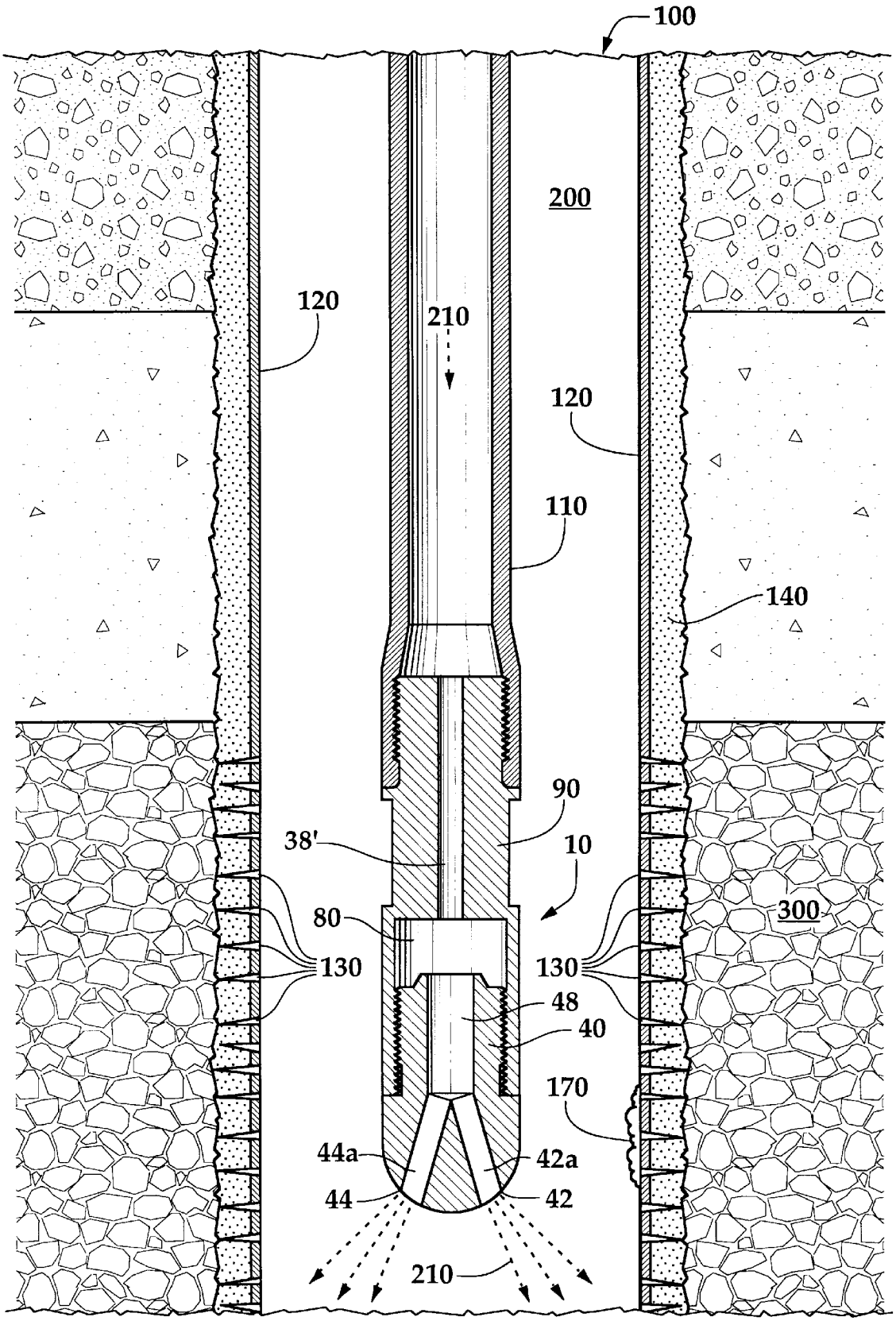
FIG. 1 is an elevation view of the self-excited jet stimulation tool of the present invention suspended proximal to perforations inside a well casing.

Reference is now made to the Drawings wherein like reference characters denote like or similar parts throughout the Figures. Referring to FIG. 1, the present invention is a self-excited jet tool 10 that creates a pulsating jet stream utilizing Helmholtz oscillation theory. The well cleaning and stimulation tool 10 is suspended in an oil well 100 on a running string 110 that extends upwards to the surface. It will be understood by those skilled in the art that the running string may include conventional 2⅜ inch or 2⅞ inch diameter upset tubing, 1 inch macaroni string tubing or coiled tubing. In some applications cross overs, as well known in the art, may be necessary to the connect the tool 10 to the running string 110. The tool 10 has been lowered into a well casing 120 opposite an interval of perforations 130.

The perforations 130 are formed by conventional perforation guns and extend radially through the casing wall 120 and the cement sheath 140 and into the hydrocarbon bearing formation 300. It will be understood by those skilled in the art that the tool 10 of the present invention may also be used in water producing wells and water injection wells. In such wells, the desired area of treatment contains water or other fluids and not hydrocarbons. The perforations 130 are generally carrot-shaped passages through which the hydrocarbons and water enter or exit the well bore. As previously discussed in the Background section, the perforations 130 may not be as conductive as possible due to damage to the perforations caused during the initial perforation process or may be plugged by particulate material from drilling or workover fluids used in the well. Additionally over time, a producing well incurs a buildup of sulfate or carbonate scale 170 and paraffin in the perforations 130 and on the inside wall of the casing 120. Unless some remedial action is taken, the passage of fluids through the perforations and into or out of the well 100 can be greatly reduced. Moreover this "plugging" of the perforations 130 can inhibit the effectiveness of various stimulation procedures where a treating fluid such as acid or fracturing fluid is to be pumped into the formation under pressure. It will be understood by those skilled the art that such stimulation procedures may also be conducted through the tool of the present invention.

Figure 2:
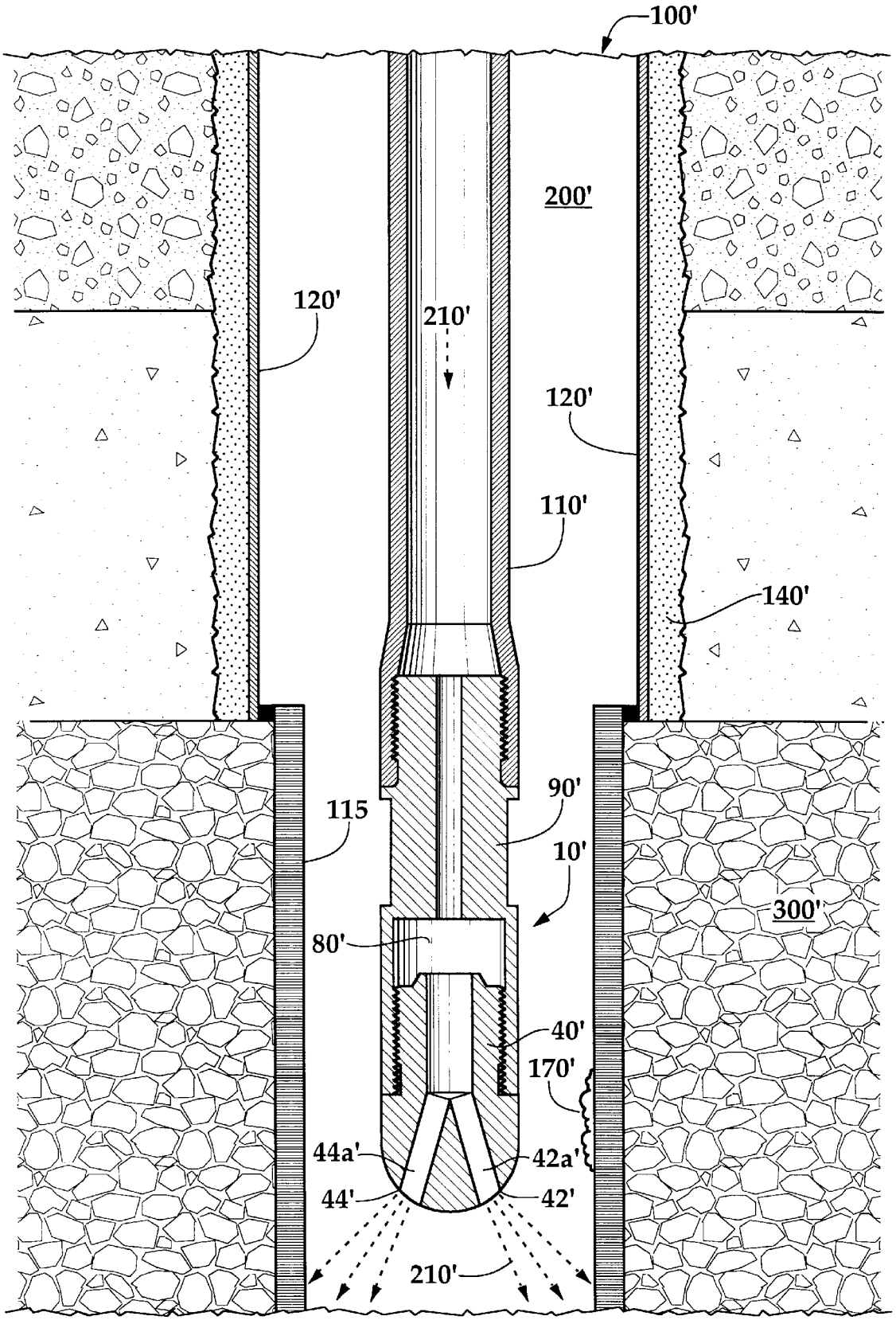
FIG. 2 is an elevation view of the tool of FIG. 1 suspended proximal to a screen liner inside a well.
Figure 3:
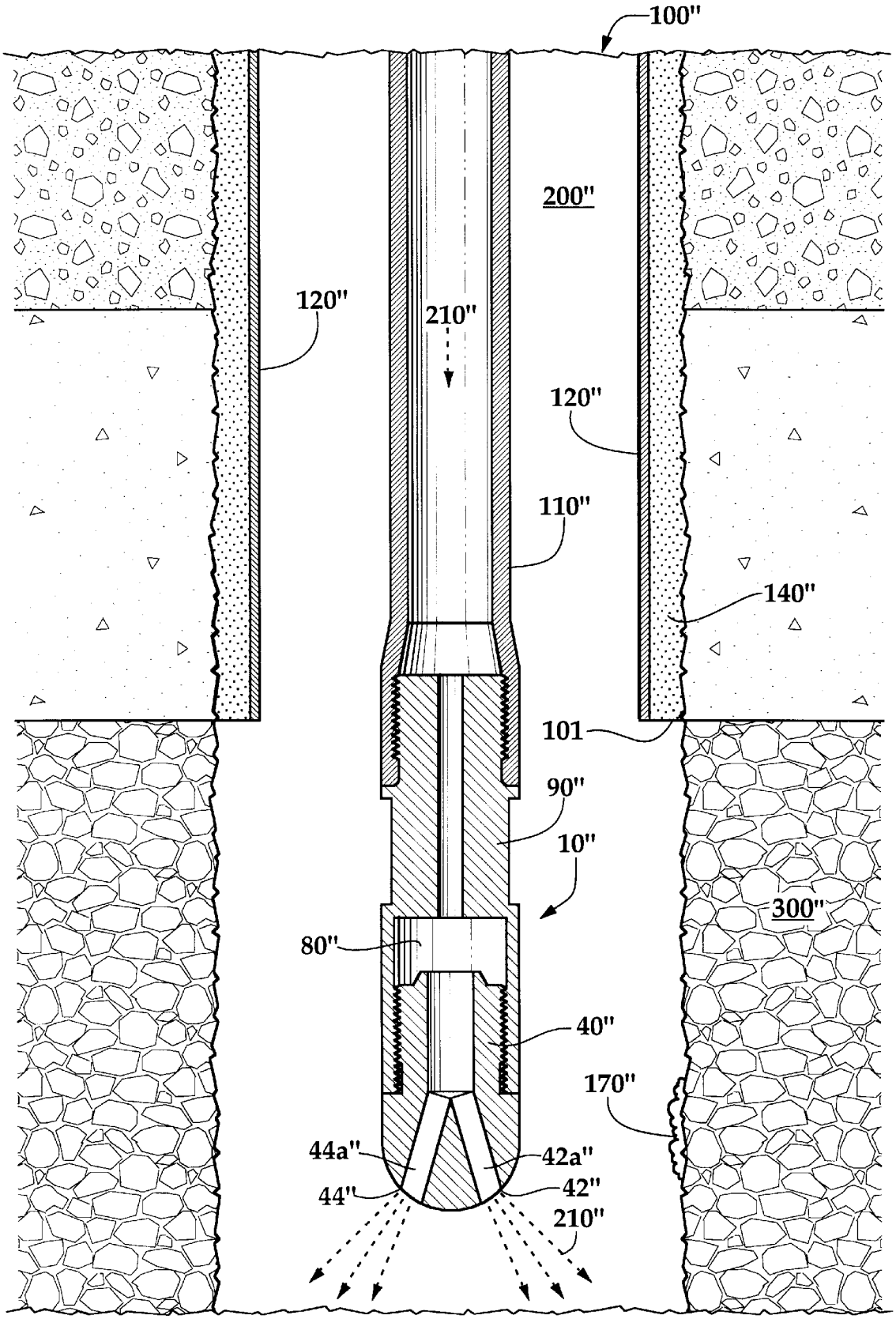
FIG. 3 is an elevation view of the tool of FIG. 1 suspended proximal to an open hole portion inside a well.

Referring to FIG. 2, wherein parts having like structure and function to parts in FIG. 1 are assigned the same reference numeral but with a (') designation, it will be apparent to those skilled in the art that the tool 10' of the present invention is equally applicable to hydrocarbon wells and fresh water wells wherein a screen "liner" 115 is positioned across the desired hydrocarbon or water bearing formation 300' instead of the conventional steel casing 120 with perforations 130 as illustrated in FIG. 1. Referring to FIG. 3, wherein parts having like structure and function to parts in FIG. 1 are assigned the same reference numeral but with a (") designation, it will be apparent to those skilled in the art that the tool 10" is applicable in "open hole completions." In open hole completions the casing 120" is terminated at a point 101 above the desired formation 300", leaving a portion of the hole bored into the formation 300" uncased ("open").

Figure 5:
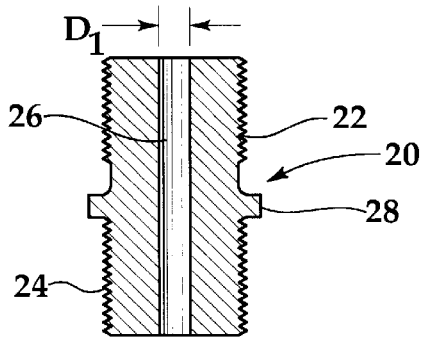
FIG. 5 is a cross section view of the inlet block of the tool of FIG. 4.
Figure 4:
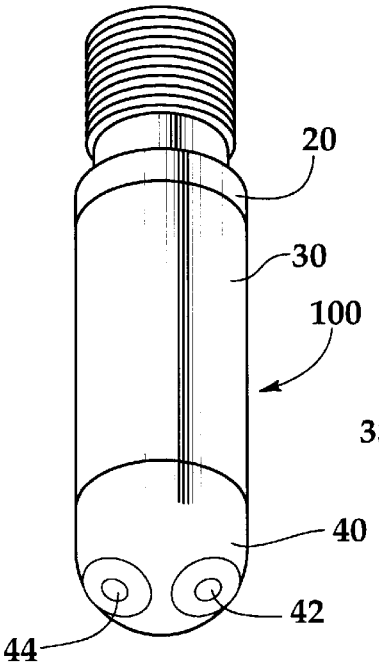
FIG. 4 is a perspective view of the assembled tool of the present invention.

Referring now to FIG. 4, therein is illustrated a perspective view of the assembled tool 10 comprised of an inlet block 20, an oscillation block 30 and a nose block 40 having exit ports 42 and 44. Referring to FIG. 5, inlet block 20 is generally tubular shaped and includes external threads 22 on an upper exterior portion and external threads 24 on a lower exterior portion with a conventional hexagonal shaped wrench flat 28 disposed therebetween. A central axial bore 26 passes through inlet block 20 and has an internal diameter $D_1$.

Figure 6:
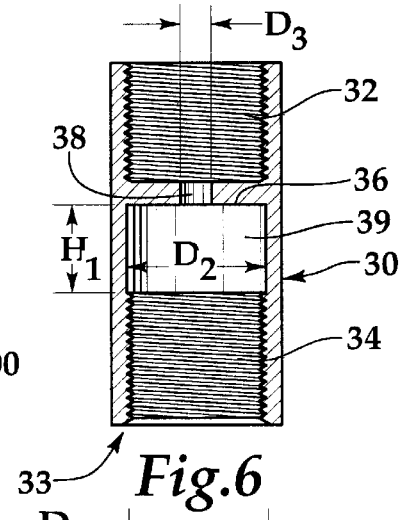
FIG. 6 is a cross section view of the oscillation block of the tool of FIG. 4.

Referring to FIG. 6, oscillation block 30 includes a generally tubular shaped body with an open ended internally threaded upper portion 32 for receiving external threads 24 of inlet block 20. Oscillation block 30 further includes a lower portion having an open ended cylindrical cavity 33 with an internally threaded lower portion 34. The cylindrical cavity 33 has an internal diameter $D_2$. Oscillation block 30 further includes a divider wall 36 disposed between the cylindrical cavity 33 and internally threaded upper portion 32. An axial passage 38 having an internal diameter $D_3=D_1$ passes through the divider wall 36 and connects the upper threaded portion 32 with the cylindrical cavity 33. For proper generation of vortices in the oscillation chamber, the height $H_1$ of the non-threaded portion is determined by the equation $H_1=3\times D_3$.

Figure 7:
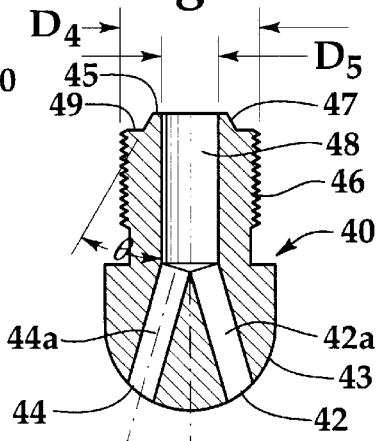
FIG. 7 is a cross section view of the nose block of the tool of FIG. 4.
Figure 8:
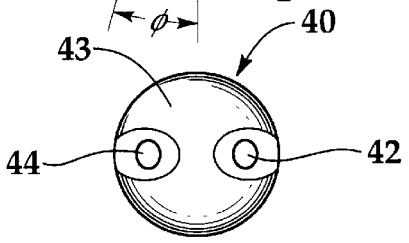
FIG. 8 is a n end view of the nose block of FIG. 7.

Referring now to FIGS. 7 and 8, nose block 40 has a generally tubular shaped body including an upper externally threaded portion 46 receivable into the lower internally threaded portion 34 of oscillation block 30. The nose block 40 further includes a top having a circular flat central portion 45, a truncated tapered conical shoulder 47 extending downwardly and outwardly away from the circular central portion, and a flat annular ledge 49 extending between the termination of the tapered conical shoulder to the edge of outside diameter $D_4$. The outside diameter $D_4$ is equal to the internal diameter $D_2$ of the unthreaded portion 39 of the cavity 33 of block 30. In the embodiment illustrated in FIGS. 7 and 8, the tapered conical shoulder extends downwardly and outwardly at an angle $\theta=30$ degrees from a vertical longitudinal axis (see also FIG. 12). The nose block 40 includes a lower externally rounded nose portion 43 with two exit ports 42 and 44. The exit ports 42 and 44 are connected by downwardly and outwardly extending axial passages 42*a* and 44*a* to a central bore 48. The central bore 48 opens to the center of the circular flat portion 45 of the top of the nose block 40. The central bore 48 has a diameter $D_5$ calculated from the equation $D_5=1.3\times D_3$. The nose ports 42 and 44 are displaced at an angle $\phi$ of 15 degrees from a central vertical axis.

The passages 42*a* and 44*a* and nozzles 42 and 44 are sized such that the total cross sectional area of the passages 42*a* and 44*a* is equal to the total cross sectional area of the ports 42 and 44 which is also equal to the cross sectional area of the central bore 48. Therefore, there is no flow restriction by passages 42*a* and 44*a* and nozzles 42 and 44. The following Table A includes dimensions $D_2$, $D_3$, $D_5$ and $H_1$ (in inches and square inches) for selected embodiments of the present invention. It will be understood by those skilled in the art that the present invention is not limited to the disclosed preferred embodiments as listed in Table A below:

TABLE A

| $D_2$ | $D_3$ | $D_5$ | $H_1$ | $D_3$ AREA | $D_5$ AREA |
|---|---|---|---|---|---|
| 1.0000 | 0.1719 | 0.22347 | 0.5157 | 0.023208 | 0.039222 |
| 1.0000 | 0.1875 | 0.24375 | 0.5625 | 0.027612 | 0.046664 |
| 1.0000 | 0.2031 | 0.26403 | 0.6093 | 0.032397 | 0.054752 |
| 1.0000 | 0.2188 | 0.28444 | 0.6564 | 0.0376 | 0.063544 |
| 1.0000 | 0.2344 | 0.30472 | 0.7032 | 0.043153 | 0.072928 |
| 1.0000 | 0.25 | 0.325 | 0.75 | 0.049088 | 0.082958 |
| 1.0000 | 0.2656 | 0.34528 | 0.7968 | 0.055405 | 0.093634 |
| 1.0000 | 0.2812 | 0.36556 | 0.8436 | 0.062104 | 0.104956 |
| 1.0000 | 0.2969 | 0.38597 | 0.8907 | 0.069233 | 0.117003 |
| 1.0000 | 0.3125 | 0.40625 | 0.9375 | 0.076699 | 0.129622 |
| 1.0000 | 0.3281 | 0.42653 | 0.9843 | 0.084548 | 0.142886 |
| 1.0000 | 0.3438 | 0.44694 | 1.0314 | 0.092833 | 0.156888 |
| 1.0000 | 0.375 | 0.4875 | 1.125 | 0.110447 | 0.186655 |
| 1.0000 | 0.4062 | 0.52806 | 1.2186 | 0.12959 | 0.219007 |
| 1.0000 | 0.4375 | 0.56875 | 1.3125 | 0.15033 | 0.254058 |
| 1.0000 | 0.4688 | 0.60944 | 1.4064 | 0.17261 | 0.291711 |

In design of the tool, the dimension $D_3$ is selected first based on the desired flow rate and pressure drop to be encountered through the tool. The dimensions $D_5$ and $H_1$ are calculated by the aforementioned design equations. The theory in support of the design equations is discussed hereinafter with regard to FIG. 12.

Figure 9:
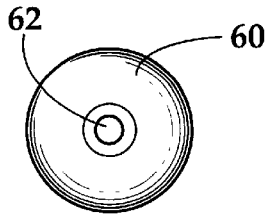
FIG. 9 is an end view of a first alternate embodiment of the nose block of the present invention.

Referring to FIG. 9, it will be understood by those skilled in the art that an alternative nose block 60 having a single discharge port 62 that is connected to central bore 48 by a single passageway in a like manner as illustrated in FIG. 5 may be used in the present invention. As discussed with regard to exit ports 42, 44 of FIG. 8, the cross sectional area of discharge port 62 equals the cross sectional area of a connecting passageway and is equal to the cross sectional area of the central bore 48.

Figure 10:
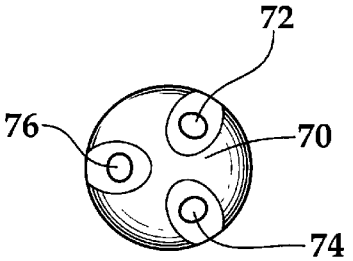
FIG. 10 is an end view of a second alternate embodiment of the nose block of the present invention.

Referring to FIG. 10, it will be understood by those skilled in the art that an alternative nose block 70 having three or more discharge ports 72, 74 and 76 connected by passageways to the central bore 48 in a like manner as illustrated in FIG. 7 may be used in the present invention. The centers of the discharge ports 72, 74 and 76 are displaced 12 degrees from a central axis through the longitudinal axis of the nose block 70. As discussed with regard to FIG. 7, the total cross sectional area of discharge ports 72, 74 and 76 equals the total cross sectional area of the connecting passageways and is equal to the cross sectional area of the central bore 48. A specific attribute of the present tool 10 is that changeable tips can be utilized to customize the tool for various applications.

Figure 11:
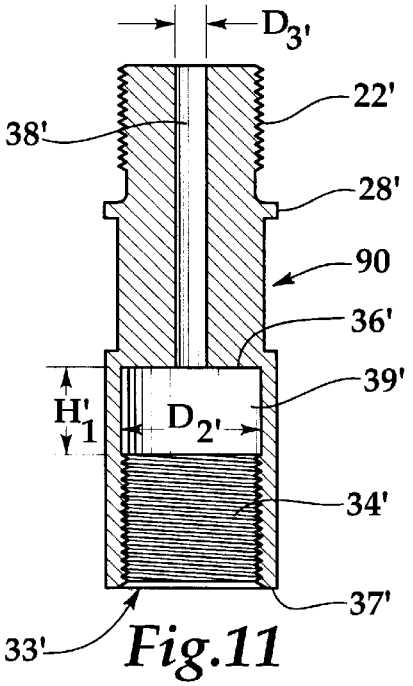
FIG. 11 is a cross section view of a composite block wherein the inlet block of FIG. 5 and the oscillation block of FIG. 6 are formed integrally in one tubular shaped member.

Referring to FIG. 11, wherein parts having like structure and function to parts in FIGS. 5 and 6 are assigned the same reference numeral but with a (') designation, therein is illustrated a second embodiment of the present invention, wherein the inlet block 20 of FIG. 5 and the oscillation block 30 of FIG. 6 may be formed integrally from a single generally tubular shaped composite block 90. Referring to FIG. 11, composite block 90 includes external threads 22' on the upper exterior portion and a conventional hexagonal shaped wrench flat 28' disposed below the external threads. A central axial bore 38' passes through composite block 90 and has an internal diameter $D_3'$. Composite block 90 further includes a lower portion having an open ended cylindrical cavity 33' with an internally threaded lower portion 34'. The cylindrical cavity 33' has an internal diameter $D_2'$. $H_1'$ is the height of the non-threaded portion 39' of the internal cavity 33'. Internal cavity 33' further includes a top wall 36'.

Referring again to FIG. 1, composite block 90 is illustrated as assembled to the nose block 40. An oscillation chamber 80 is formed internally in the tool 10 by the assembly of composite block 90 to nose block 40. Likewise oscillation chamber 80 may be formed internally in the tool 10 by the assembly of oscillation block 30 to nose block 40. Similarly, it will be understood that the oscillation chamber 80 may also be formed by the assembly of composite block 90 with nose block 60 or 70 or oscillation chamber 80 may be formed by assembly of block 30 with nose block 60 or 70.

Figure 12:
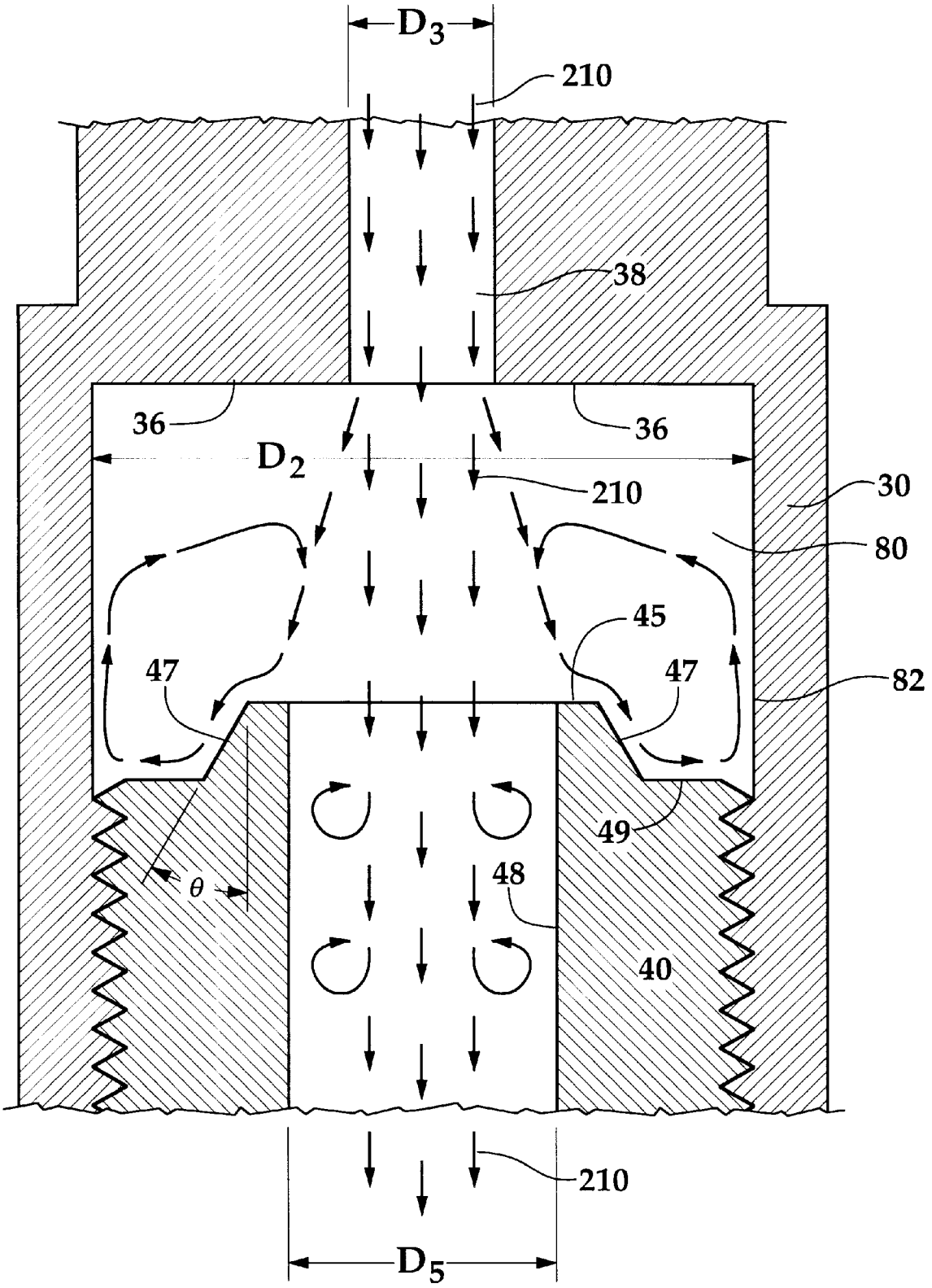
FIG. 12 is an enlarged cross section view of an oscillation chamber of the tool of the present invention.

Referring now to FIG. 12, wherein there is illustrated an enlarged cross section view of the Helmholtz oscillation chamber 80 formed by the mating of oscillation block 30 and nose block 40. The treating fluid 210, comprising brine, fresh water, acid, gelled water or the like, is supplied from the running string 110 and enters the oscillation chamber 80 from the inlet bore 38 (see FIG. 1).

As illustrated in FIG. 12 a steady continuous round inlet jet from inlet bore 38 is discharged into the axisymmetric oscillation chamber 80 and then out the outlet bore 48. The diameter $D_2$ of the oscillation chamber is much larger than the diameter $D_3$ of the inlet bore 38; therefore, the speed of the fluid in the cavity is far lower than that of the inlet jet. The discrepancy of the fluid speed leads to a fierce shear movement at the interface of the fast and slower moving fluids in the chamber 80. Because of the viscosity of the fluid there must be a momentum exchange between the two fluids thorough the interface. The shear flow results in vortices. With the inlet jet being round, the vortex lines take the shape of a circle; i.e., the vortices come about and move in the form of a vortex ring. The impingement of orderly axisymmetric disturbances, such as the vortex ring, in the shear layer on the edge of the discharge bore 48 generates periodic pressure pulses. These pressure pulses propagate upstream to the sensitive initial shear layer separation region and induce vorticity fluctuations. The inherent instability of the jet shear layer amplifies small disturbances imposed on the initial region. This amplification is selective; i.e., only disturbances with a narrow frequency range get amplified. Where f=frequency; $U_O$=velocity at the jet axis; $D_3$=diameter of the inlet bore; and $S_D$=dimensionless frequency=$fD_3/U_0$; if the frequency of a disturbance is $f=S_DU_O/D_3$ the disturbance will receive maximum amplification in the jet shear layer between the initial separation region and the impingement zone. The amplified disturbance travels downstream to impinge on the edge again. Thereupon the events above are repeated in a loop consisting of emanation, feedback and amplification of disturbances. As a result, a strong oscillation is developed in the shear layer and even in the jet core. A fluctuation pressure field is set up within the oscillation chamber 80. The velocity of the jet emerging from the outlet bore 48 varies periodically, thus a pulsed jet is produced. The oscillation is referred to as self-excited oscillation because it comes into being without any external control or excitation. Low frequency, self-excited oscillation is observed when the oscillation chamber height $H_1$ varies in the range of $1.6<H_1/D_3<5.6$. Low frequency oscillation has a relatively high pressure fluctuation rate. In a desired range of operation the tool 10 creates pressure pulsations between 100 and 245 cycles per second. A further discussion of design parameters for self-excited oscillation jet nozzles is included in a paper entitled "Nozzle Device for the Self-Excited Oscillation of a Jet" presented as paper 19 at the 8th International Symposium on Jet Cutting Technology held in Durham, England, Sep. 9–11, 1986 and available from BHRA, the Fluid Engineering Centre, Cranfield, Bedford MK43OAJ, England, incorporated herein by reference.

In operation, as illustrated in FIGS. 1, 2 and 3, the tool 10 is run in a well 100 filled with annular fluid 200. Surface pumps (not shown) are used to pump treating fluid 210 down the running string 110 at typical preselected rates and pressures as discussed hereinabove in order to provide a resonant frequency of oscillation in the oscillation chamber 80. The vortices and attenuate pressure pulsations in the fluid 210 exit the oscillation chamber through the central bore 48 in the bottom of the chamber 80 and are discharged through the discharge ports 42 and 44 of the tool 10. The discharged fluid creates a pulsating shock wave in the annular fluid 200 in the well 100. The pulsating shock wave subjects the perforations 130 and the scale 170 to pressure changes which cause cyclical tension and compressive stresses therein and which break down the scale and material clogging the perforations and the well 100. Additionally the pressure waves may break down portions of the formation 300 and stimulate the well 100. The time that the treating tool 10 is left in proximity to the perforation 130 is dependent on the amount of scale and the hardness of the formation 300. Debris from the perforations 130 and scale 170 is circulated out of the well 100 as treating fluid 210 and annular fluid 200 are returned to the surface via the annular space between the running string 110 and the casing 120.

Empirically it has been determined that the pressures and flow rates as described below produce the desired cleaning and/or stimulation of wells of all types of hydrocarbon and water bearing formations. For a typical tool 10 run on a 1 inch coiled tubing running string 110, $D_2$=1 inch, $D_3$=0.2188 inch, $D_5$=0.28444 inch and $H_1$=0.6564 inch, the treating rate will be approximately 1 barrel per minute at a surface pump pressure of 2000 to 2500 psi. Alternatively, for a typical tool 10 run on a 2⅜ inch tubing running string 110, $D_2$=1 inch, $D_3$=0.3125 inch, $D_5$=0.40625 inch and $H_1$=0.9375 inch, the treating rate will be approximately 2 barrels per minute at 2000 to 2500 psi.

In some wells, the desired formation does not contain sufficient pressure to maintain a hydrostatic column of annular fluid 200 in the well bore. Therefore, annular fluid 200 cannot be circulated to the surface because it is lost to the formation 300. It will be understood by those skilled in the art that the tool 100 may still be used to clean and stimulate such wells. In such applications, the pulsating spray impinges on the perforations 130 and upon the casing wall 120 and cleans them of debris and scale. Some of the debris and scale may be forced away from the well bore deeper into the formation thereby providing improved conductivity near the well bore, and some of the debris and scale may fall to the lower portion of the well bore below the desired zone 300.

Although preferred and alternate embodiments of the invention have been illustrated in the accompanying Drawings and described in the foregoing Detailed Description, it will be understood the invention is not limited to the embodiments disclosed but is capable of numerous modifications without departing from the scope of the invention as claimed.

I claim:

1. A self-excited jet stimulation tool for use inside a well, said jet tool comprising:

an elongated tubular first member adapted on an upper end for connection to a running string, said first member comprising:

an upper portion with a central bore open to a top of the tool, and a lower portion having a cylindrical shaped cavity open to a bottom surface of the first member, said cylindrical cavity having an internal diameter larger than the diameter of the central bore of the upper portion, said central bore of the first member open to the cylindrical cavity for communication of fluids supplied by the running string; and an elongated tubular second member comprising:

a top having a central bore with a diameter larger than the diameter of the central bore of the first member but less than the diameter of the cylindrical cavity of the first member, an upper portion receivable in the cylindrical cavity of the first member, and a lower nose portion having at least one discharge port connected by a passageway to the central bore of the second member;

wherein said tool being assembled with the upper portion of the second member received in the cylindrical cavity of the lower portion of the first member thereby forms an oscillation chamber having a height equal to about three times the diameter of the central bore of the upper portion of the first member.

2. A self-excited jet stimulation tool for use inside a well, said jet tool comprising:

an elongated tubular first member adapted on an upper end for connection to a running string, said first member comprising:

an upper portion with a central bore open to a top of the tool, and a lower portion having a cylindrical shaped cavity open to a bottom surface of the first member, said cylindrical cavity having an internal diameter larger than the diameter of the central bore of the upper portion, said central bore of the first member open to the cylindrical cavity for communication of fluids supplied by the running string; and an elongated tubular second member comprising:

a top having a central bore with a diameter larger than the diameter of central bore of the first member but less than the diameter of the cylindrical cavity of the first member, a truncated conical shoulder extending downwardly and outwardly away from the central bore, said truncated conical shoulder terminating in a flat annular ledge extending beyond the termination of the truncated conical shoulder, an upper portion receivable in the cylindrical cavity of the first member, and a lower nose portion having at least one discharge port connected by a passageway to the central bore of the second member;

wherein said tool being assembled with the upper portion of the second member received in the cylindrical cavity of the lower portion of the first member thereby forms an oscillation chamber having a height equal to about three times the diameter of the central bore of the upper portion of the first member.

3. A self-excited jet stimulation tool for use inside a well, said jet tool comprising:

an elongated tubular first member adapted on an upper end for connection to a running string, said first member comprising:

an upper portion with a central bore open to a top of the tool, and a lower portion having a cylindrical shaped cavity open to a bottom surface of the first member, said cylindrical cavity having an unthreaded upper section and an internally threaded lower section, said cylindrical cavity having an internal diameter larger than the diameter of the central bore of the upper portion and an interior wall having a height of the unthreaded upper section less than the diameter of the cylindrical cavity, said central bore of the first member open to the cylindrical cavity for communication of fluids supplied by the running string; and an elongated tubular second member comprising:

a top having a central flat circular portion, said central flat circular portion having a central bore with a diameter larger than the diameter of the central bore of the first member but less than the diameter of the cylindrical cavity of the first member, a conical shoulder extending downwardly and outwardly away from the central flat circular portion, an upper portion externally threaded and receivable in the internally threaded lower section of the first member, and a lower nose portion having at least one discharge port connected by a passageway to the central bore of the second member;

wherein said tool being assembled with the upper portion of the second member threadedly engaged in the lower section of the first member thereby forming an oscillation chamber contained internally therein.

4. A self-excited jet stimulation tool for use inside a well, said jet tool comprising:

an elongated tubular first member adapted on an upper end for connection to a running string, said first member comprising:

an upper portion with a central bore open to a top of the tool, and a lower portion having a cylindrical shaped cavity open to a bottom surface, said cylindrical cavity having an unthreaded upper section and an internally threaded lower section, said cylindrical cavity having an internal diameter larger than the diameter of the central bore of the upper portion and an interior wall having a height of the unthreaded upper section less than the diameter of the cylindrical cavity, said central bore of the first member open to the cylindrical cavity for communication of fluids supplied by the running string; and an elongated tubular second member comprising:

a top having a central flat circular portion, said central flat circular portion having a central bore with a diameter larger than the diameter of central bore of the first member but less than the diameter of the cylindrical cavity of the first member, a conical shoulder extending downwardly and outwardly away from the central flat circular portion, said conical shoulder terminating in a flat annular ledge extending beyond the termination of the conical shoulder, an upper portion externally threaded and receivable in the internally threaded lower section of the first member, and a lower nose portion having at least one discharge port connected by a passageway to the central bore of the second member;

wherein said tool being assembled with the upper portion of the second member threadedly engaged in the lower section of the first member thereby forming an oscillation chamber contained internally therein.

5. The jet stimulation tool of claim 4 wherein the nose portion includes at least two discharge ports disposed about 15 degrees from a central longitudinal axis of the tool and opposite each other.

6. The jet stimulation tool of claim 4 wherein the nose portion includes three discharge ports disposed about 12 degrees from a longitudinal axis and equidistant from each other.

7. The jet stimulation tool of claim 4 wherein the conical shoulder is disposed at an angle of about 30 degrees from a longitudinal axis.

8. A self-excited jet stimulation tool for use inside a well, said jet tool comprising:

an elongated tubular first member adapted on an upper end for connection to a running string, said first member comprising:

a lower portion having an externally threaded portion, and a central bore extending therethrough;

an elongated tubular second member comprising;

an upper portion internally threaded to receive the externally threaded lower portion of the first member, a lower portion having a cylindrical cavity open to a bottom surface, said cylindrical cavity having an unthreaded upper section and an internally threaded lower section said cylindrical cavity having an internal diameter larger than the diameter of the central bore of the first member and an interior wall having a height of the unthreaded upper section less than the diameter of the cylindrical cavity, an internal divider wall disposed between the upper and lower portion, and a central bore passing through the divider wall and open to the top of the second member and open to the cylindrical cavity of the second member; and an elongated tubular third member comprising:

a top having a central flat circular portion, said central flat circular portion having a central bore with a diameter larger than the diameter of central bore of the first member but less than the diameter of the cylindrical cavity of the second member, a conical shoulder extending downwardly and outwardly away from the central flat circular portion, said conical shoulder terminating in a flat annular ledge extending beyond the termination of the conical shoulder, an upper portion externally threaded and receivable in the internally threaded section of the lower portion of the second member, and a lower nose portion having at least one discharge port connected by a passageway to the central bore of the third member; wherein said tool being assembled with the upper portion of the second member threadedly engaged in the lower portion of the first member and the upper portion of the third member is threadedly engaged in the lower portion of the second member thereby forming an oscillation chamber contained internally therein.

9. A self-excited jet stimulation tool for use inside a well, said jet tool comprising an upper tubular bore having a first internal diameter, an oscillation chamber having a second internal diameter disposed below the upper tubular bore and communicating therewith, a lower tubular bore having a third internal diameter and a first continuous cross-sectional area disposed below the oscillation chamber and communicating therewith along a common longitudinal axis, the upper and lower tubular bores and the oscillation chamber being coaxially aligned, and a plurality of exit passageways having a combined second cross-sectional area disposed generally below and communicating with the lower tubular bore; the second internal diameter being greater than the first and third internal diameters; the third internal diameter being about 1.3 times the first internal diameter;

the oscillation chamber having a height ($H_1$) about three times the first internal diameter; and the first and second cross sectional areas being about equal.

10. The tool of claim 9 wherein the oscillation chamber further comprises a truncated, conical shoulder extending downwardly and outwardly away from a top end of the lower tubular bore, said conical shoulder having a top and bottom and a flat annular ledge surrounding the bottom of the conical shoulder.

11. The tool of claim 10 wherein the conical shoulder extends outwardly at an angle of about 30 degrees from the longitudinal axis through the chamber.

12. The tool of claim 9 wherein the exit passageways diverge from the longitudinal axis through the lower tubular bore at an angle ranging from about 12 to about 15 degrees.

* * * * *